US009454133B2

(12) United States Patent
Goeller

(10) Patent No.: US 9,454,133 B2
(45) Date of Patent: Sep. 27, 2016

(54) TIMEPIECE CALENDAR MECHANISM

(71) Applicant: Montres Breguet S.A., L'Abbaye (CH)

(72) Inventor: Eric Goeller, Colombier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/958,429

(22) Filed: Dec. 3, 2015

(65) Prior Publication Data

US 2016/0187854 A1 Jun. 30, 2016

(30) Foreign Application Priority Data

Dec. 29, 2014 (EP) ..... 14200382

(51) Int. Cl.
*G04B 19/253* (2006.01)
*G04B 19/257* (2006.01)

(52) U.S. Cl.
CPC ..... *G04B 19/2576* (2013.01); *G04B 19/2536* (2013.01); *G04B 19/25333* (2013.01)

(58) Field of Classification Search
CPC .. G04B 19/2536; G04B 19/24; G04B 19/25; G04B 19/25353; G04B 19/25333; G04B 19/26
See application file for complete search history.

(56) References Cited

U.S. PATENT DOCUMENTS 7,139,224 B2 * 11/2006 Schneider ..... G04B 19/253 368/28
7,307,917 B2 * 12/2007 Meylan ..... G04B 19/24 368/28
7,480,211 B2 * 1/2009 Golay ..... G04B 19/2536 368/28
7,706,214 B2 * 4/2010 Scheufele ..... G04B 19/2536 368/28
8,059,492 B2 * 11/2011 Watanabe ..... G04B 19/2536 368/37

FOREIGN PATENT DOCUMENTS

GB 430109 6/1935

OTHER PUBLICATIONS

European Search Report issued Oct. 21, 2015 in European application 14200382, filed on Dec. 29, 2014 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Watch comprising a movement arranged to drive a timepiece calendar mechanism, which includes drive means that drive, at each change in month, complementary drive means arranged to drive a month cam whose periphery cooperates with a month feeler arm comprised in the calendar mechanism, where this month cam covers an angular sector of less than 360°, and the calendar mechanism includes elastic return means arranged to instantaneously return the month cam in a backward movement, in cooperation with the month feeler, to the position of the first month of the year upon completion of the last day of the preceding year.

8 Claims, 9 Drawing Sheets

TIMEPIECE CALENDAR MECHANISM

This application claims priority from European Patent Application NO 14200382.1 filed Dec. 29, 2014, the entire disclosure of which is hereby incorporated herein by reference.

FIELD OF THE INVENTION

The invention concerns a timepiece calendar mechanism, including drive means arranged to drive, at each change in month, complementary drive means arranged to drive a month cam pivoting about a pivot axis, said month cam having a periphery that cooperates with a month feeler arm comprised in said calendar mechanism.

The invention also includes a watch comprising a movement arranged to drive such a calendar mechanism.

The invention concerns the field of watch calendar mechanisms, and more specifically including a perpetual calendar mechanism.

BACKGROUND OF THE INVENTION

The most conventional date timepieces are described in particular in the work entitled "Les montres compliquées" (*A Guide to Complicated Watches*) by François Lecoultre and edited by Editions Horlogères in Bienne.

In a calendar mechanism, a ratchet or month star carrying a month cam is driven, at each change in month, by a lever which cooperates with a day-snail and jumps when the steep side of the day-snail is crossed.

The period of one complete revolution of the month cam is usually twelve or forty-eight months.

This month cam includes, on the periphery thereof, notches or surfaces, the radial dimension of which corresponds to the duration of the different months, and which occupies a significant amount of space which is not always compatible with that of the other mechanisms and complications in the timepiece.

The function of a so-called perpetual calendar device is to determine the number of days in the current month, and, more specifically, in the month of February. The perpetual mechanism is an approximate notion: most commercially available mechanisms are simple leap year mechanisms, either using a month cam with 48 notches, or a month cam with twelve positions, where the February position includes a leap year mechanism with a Maltese Cross or similar element, to mention the best known devices.

The design of a perpetual calendar device meets with two difficulties:

how to take account of the specificities of the type of calendar concerned and translate this into the form of a timepiece mechanism, and how to update such a mechanism in case of stoppage. Updating is often so complex that the timepiece must never be stopped, as is the case of astronomical clocks for buildings. Even in the case of the most basic version of a perpetual Gregorian calendar that simply manages leap years in four-year cycles, any updating is accomplished by a large number of operations, up to 47 manoeuvres to arrive at the right year and the right month, which results in wear of the mechanisms.

SUMMARY OF THE INVENTION

The invention proposes to minimise the volume of a watch calendar mechanism, in particular including a perpetual calendar which allows for ordinary leap years, while reducing the number of update operations required of the user after the watch has stopped.

To this end, the invention concerns a watch calendar mechanism comprising drive means arranged to drive, at each change in month, complementary drive means arranged to drive a month cam pivoting about a pivot axis, said month cam having a periphery which cooperates with a month feeler arm comprised in said calendar mechanism, characterized in that said month feeler arm always occupies the same angular position with respect to said pivot axis, and in that said month cam covers an angular sector of less than 360° with respect to said pivot axis, and in that said calendar mechanism includes elastic return means arranged to instantaneously return said month cam in a backward movement, in cooperation with said month feeler arm, to the position of the first month of the year upon completion of the last day of the preceding year, and said month cam including an edge arranged to cooperate, on the last day of the year, with an off-centre stop member comprised in said calendar mechanism, to control a backward movement of said month cam under the action of said elastic return means.

The invention further includes a watch including a movement arranged to drive such a calendar mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
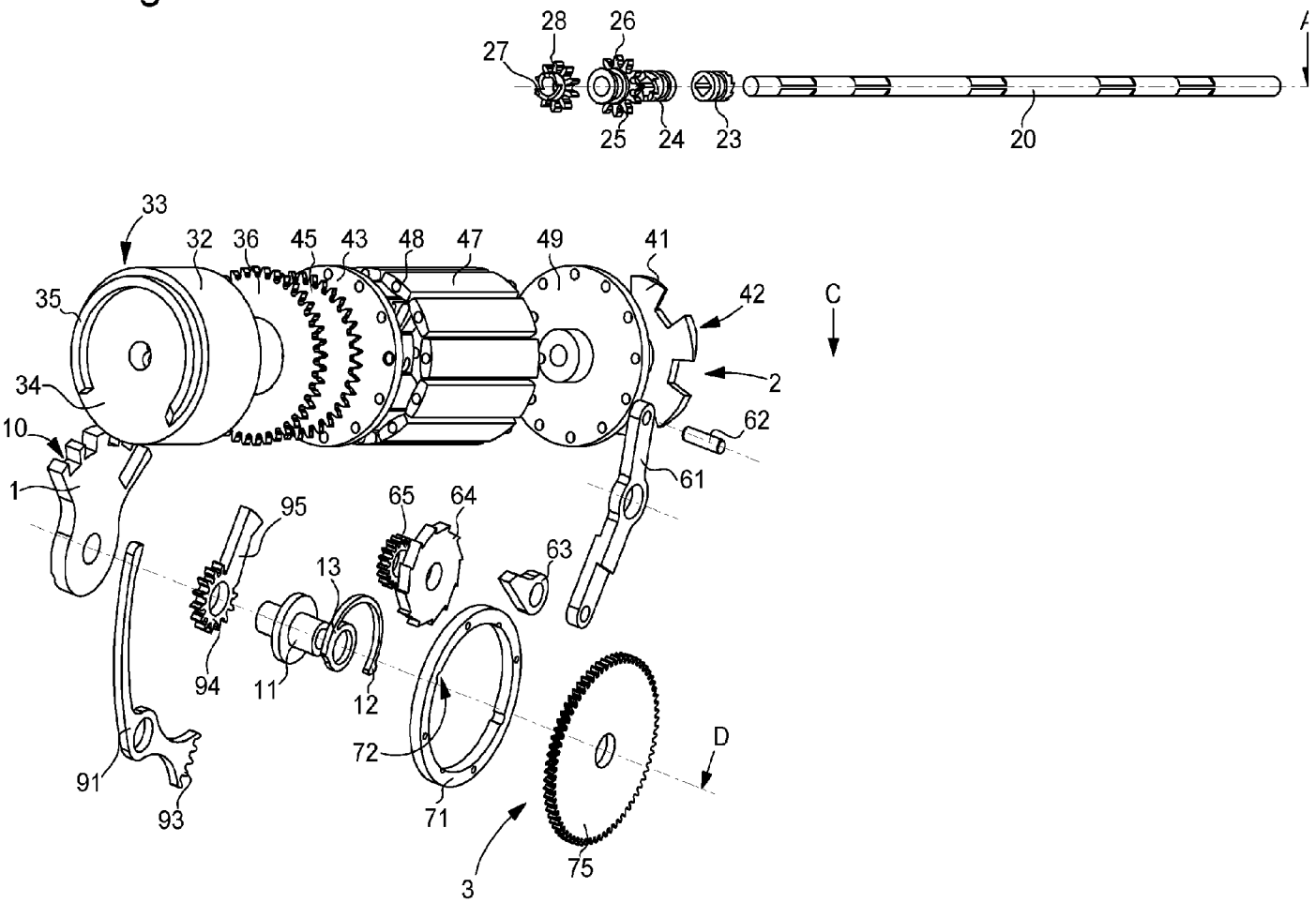
FIGS. 1 to 4 show schematic, partial, exploded, perspective views, from different angles, of a calendar mechanism according to the invention; the usual month feeler arm in a calendar mechanism is not shown.
Figure 2:
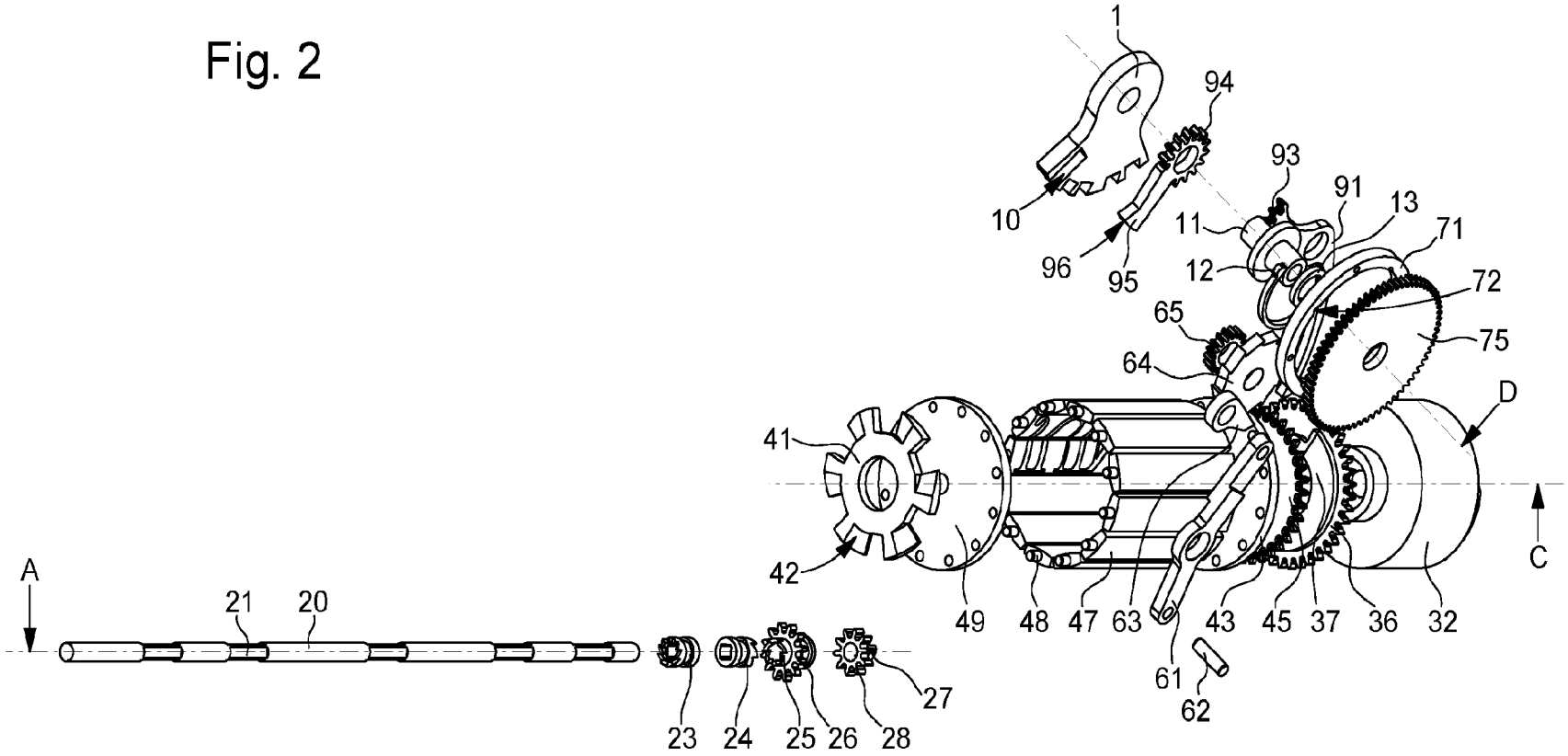
Figure 3:
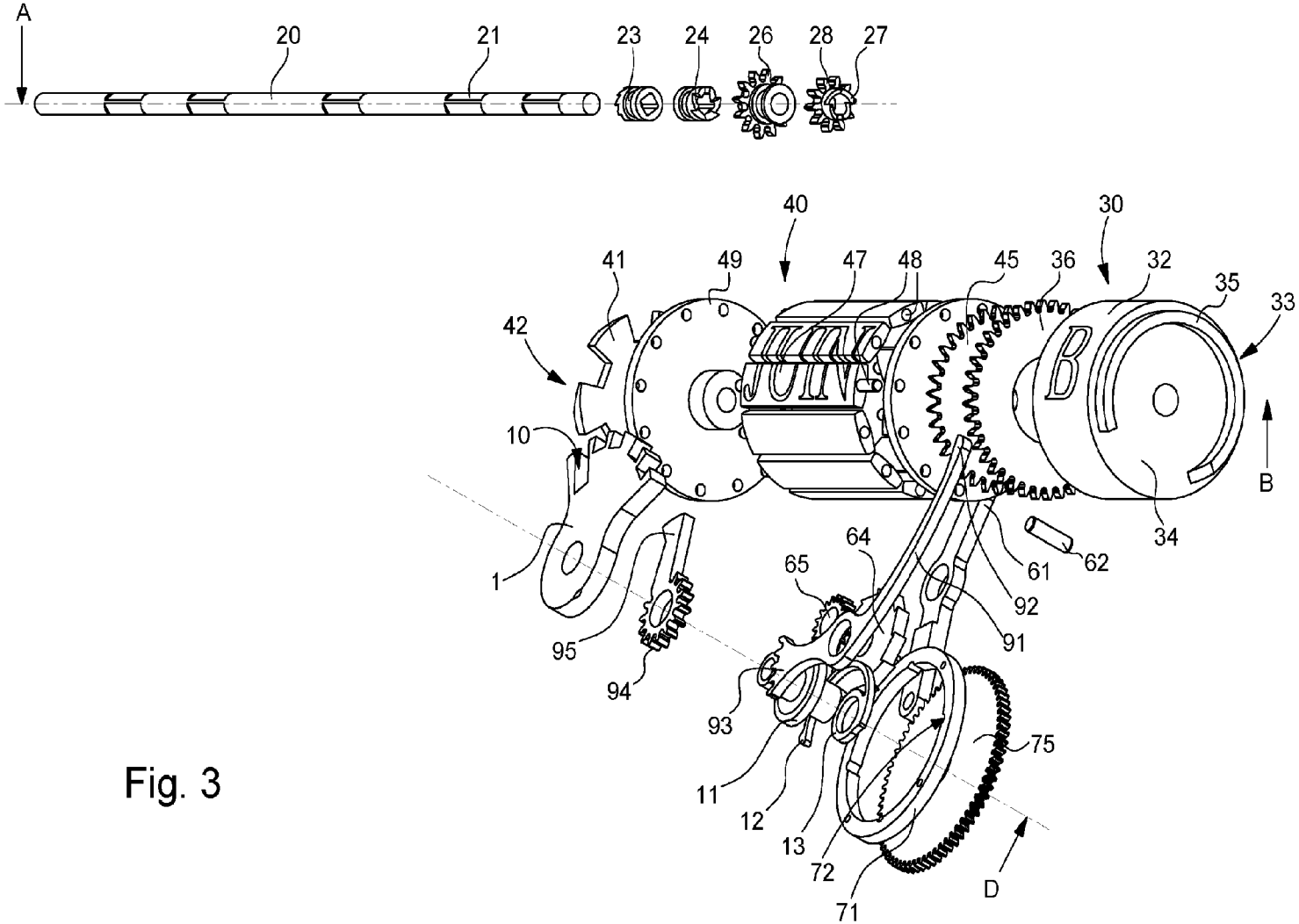
Figure 4:
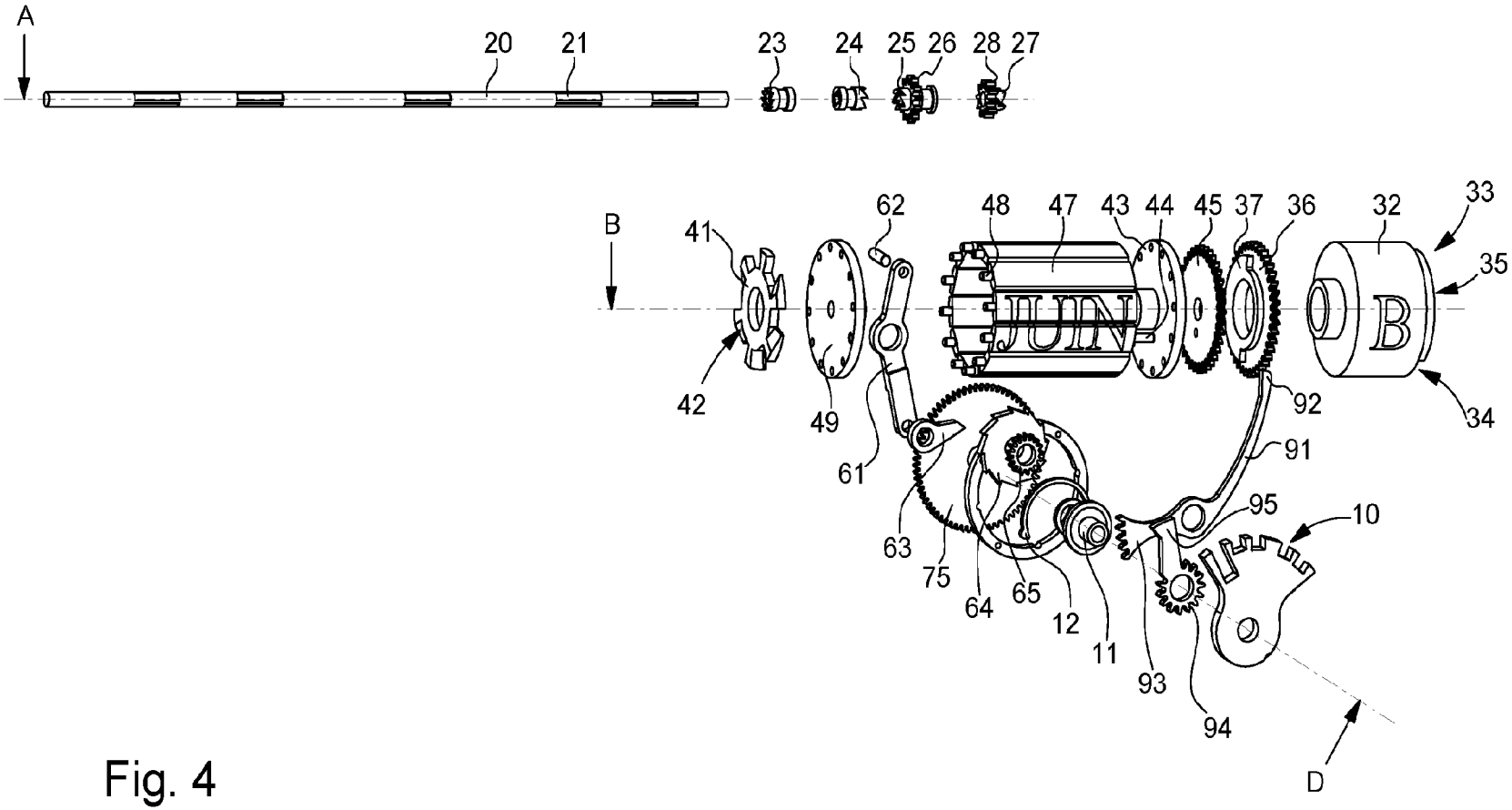
Figure 5:
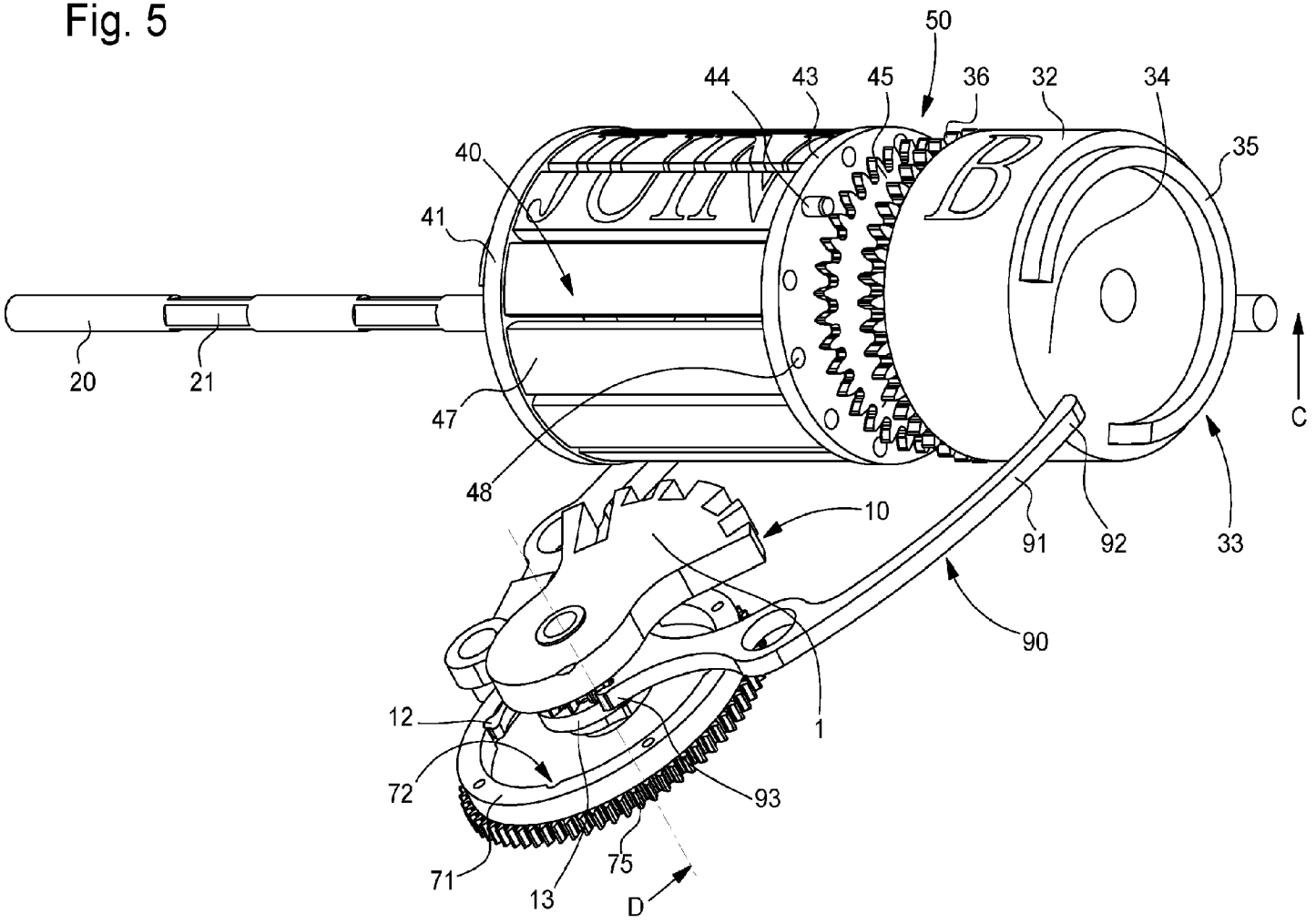
FIGS. 5 to 7 show the same mechanism of FIGS. 1 to 4, in an assembled version, and in a position where the end of a lever feels a four-year cam track corresponding to a leap year, whereas the feeler finger of a lever is in position in a notch of a twelve-star, at the foot of a month change ramp.
Figure 6:
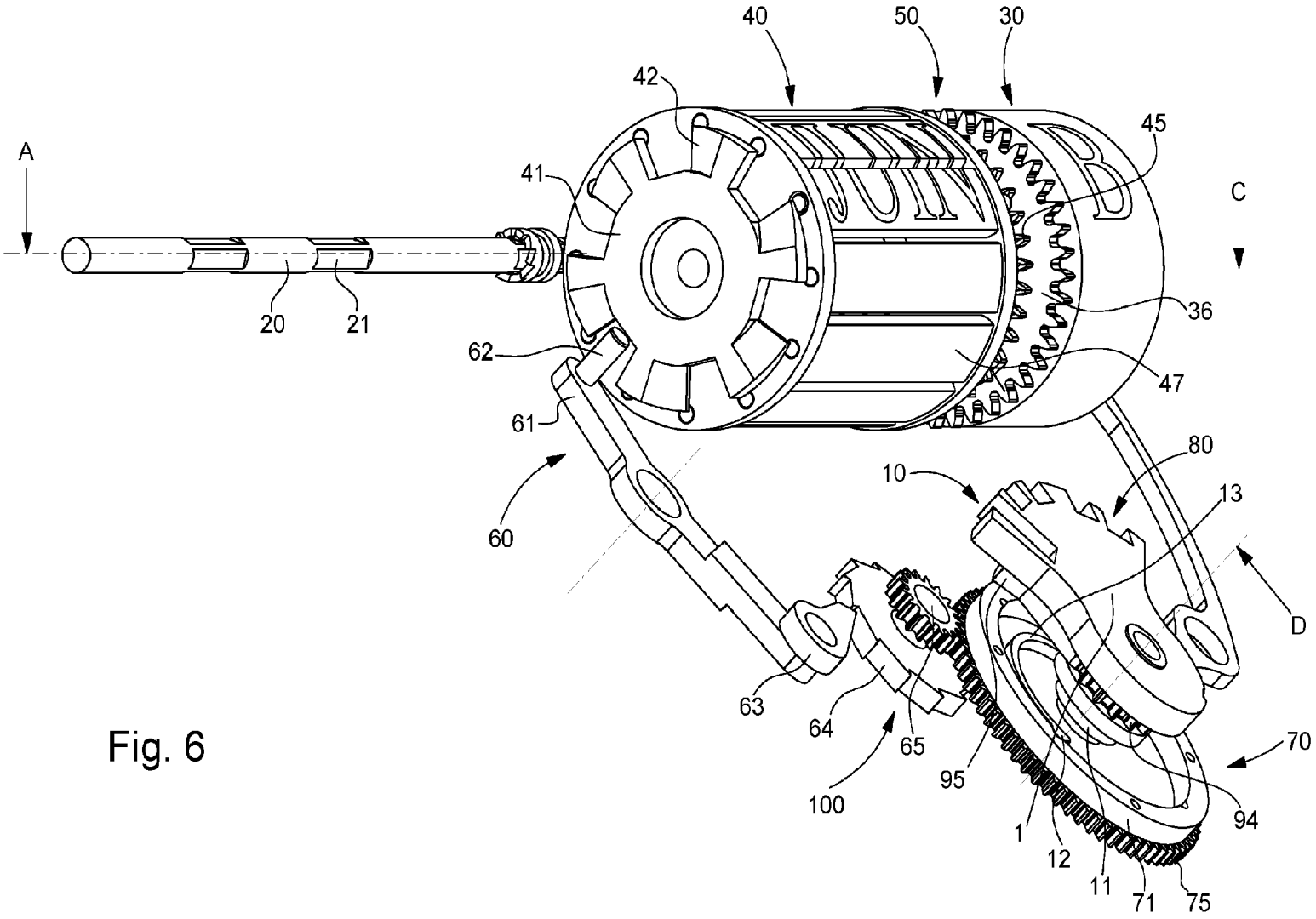
Figure 7:
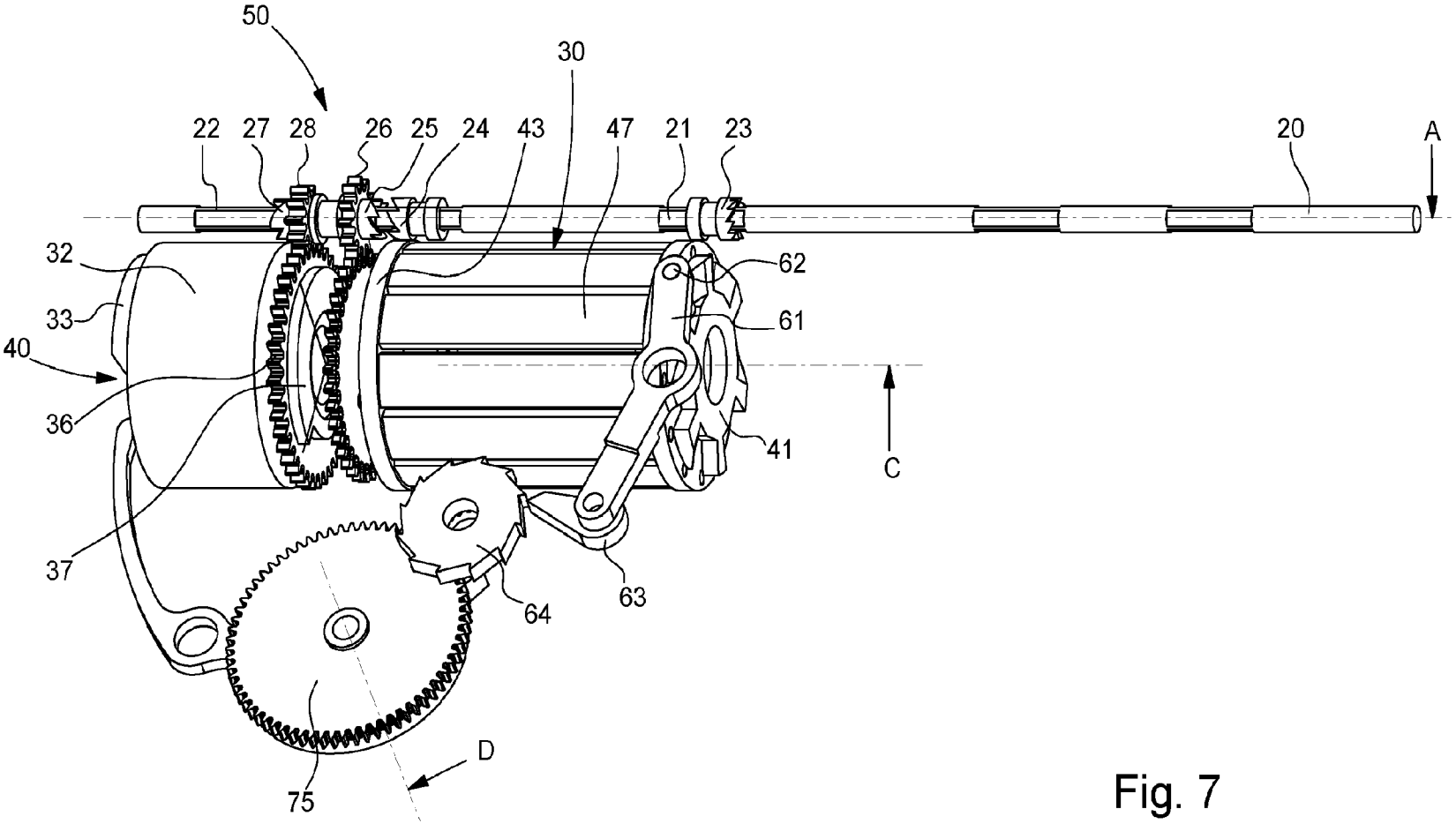
Figure 8:
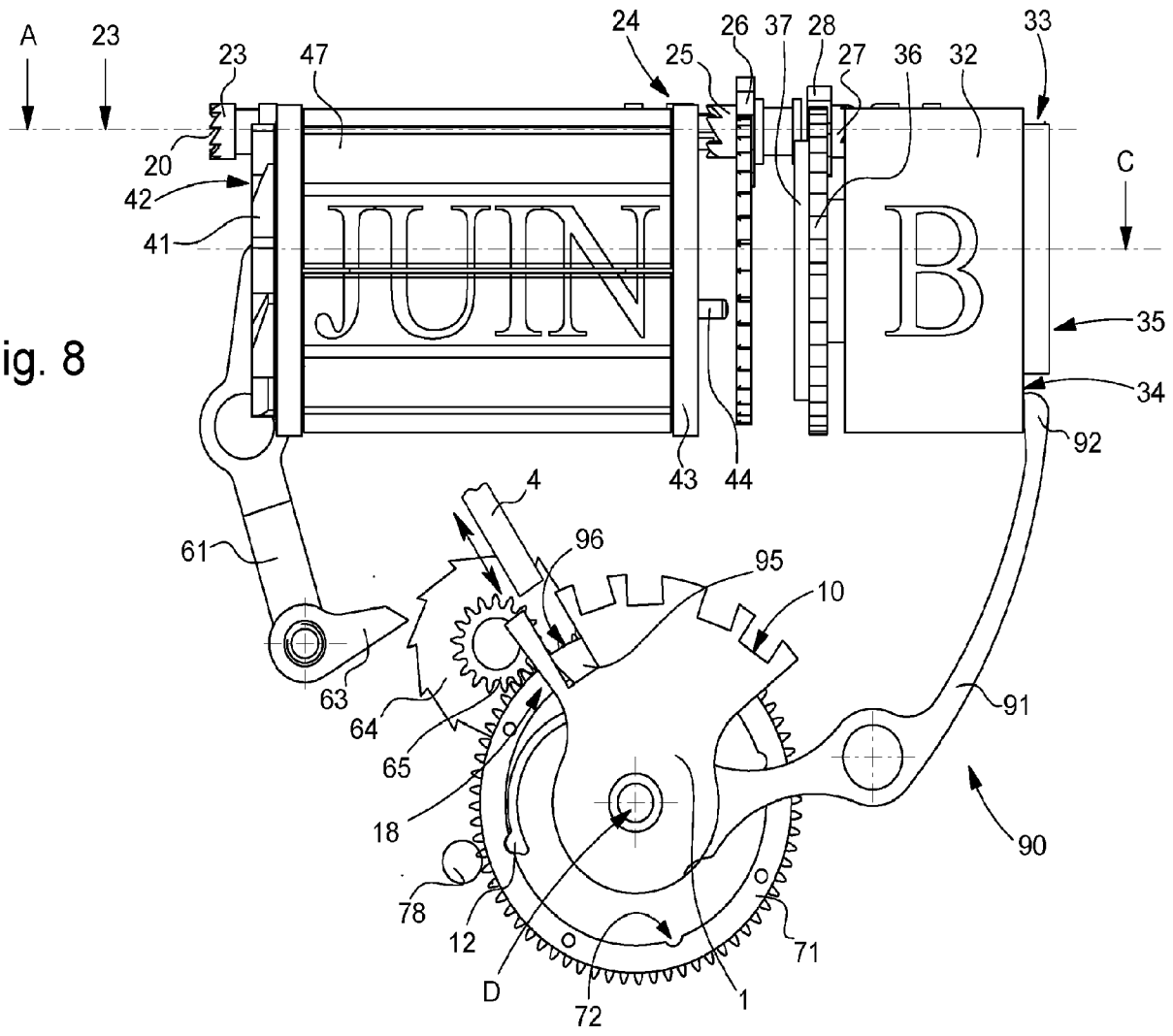
FIG. 8 shows a schematic front view of the same mechanism with the end of a month feeler arm facing a February notch comprised in the periphery of a month cam, in proximity to which is arranged an off-centre stop member arranged to cause a backward movement of this month cam at the end of the year.
Figure 9:
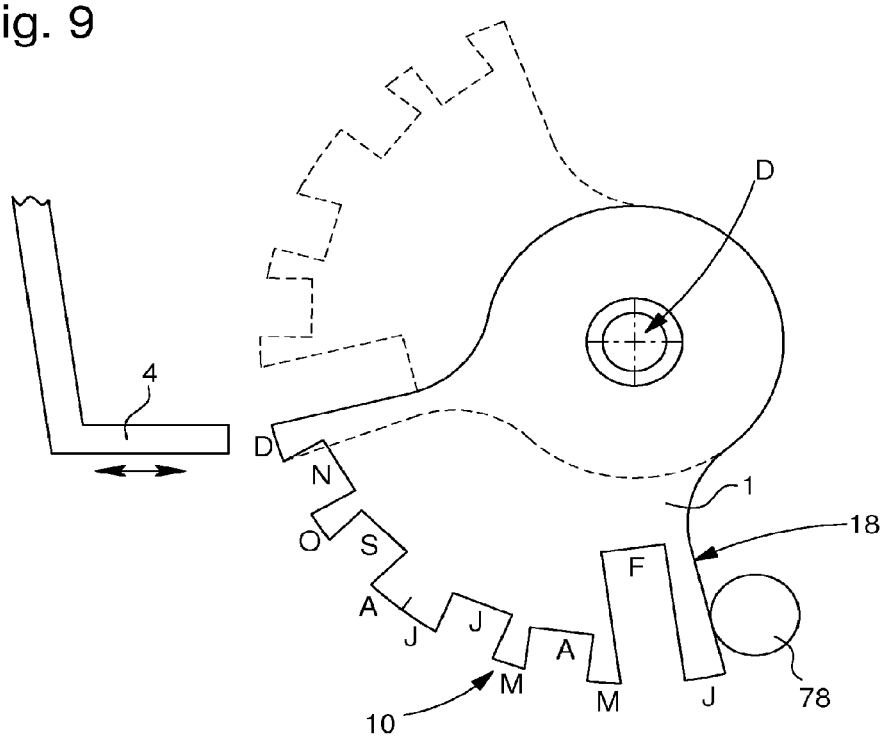
FIG. 9 shows a schematic front view of the month cam, in dashed lines in a first, initial position corresponding to January, after its backward return, and in solid lines at the end of December, in immediate proximity to the off-centre stop member of FIG. 8 at the moment immediately preceding the backward jump.
Figure 10:
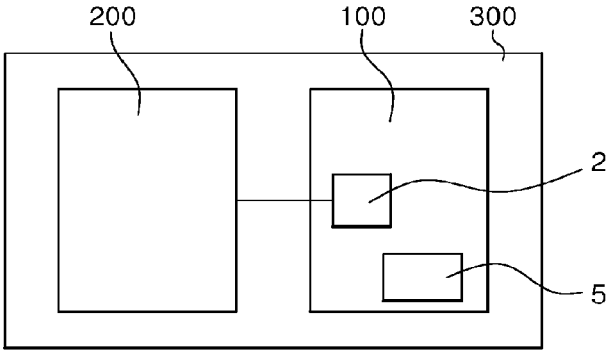
FIG. 10 is a block diagram showing a watch including a movement arranged to drive the calendar mechanism, which includes a means of displaying the month.

The invention concerns a timepiece calendar mechanism 100, comprising drive means 2 arranged to drive, at each change in month, complementary drive means 3 arranged to drive a month cam 1 pivoting about a pivot axis D.

This month cam 1 includes a periphery 10 that cooperates with a month feeler arm 4 comprised in calendar mechanism 100. In a particular but non-limiting manner, this periphery includes sectors of different radial dimension according to the duration of the month, and thus includes a plurality of notches.

Month feeler arm 4 always occupies the same angular position with respect to pivot axis D, and month cam 1 covers an angular sector of less than 360° with respect to pivot axis D.

In a particular embodiment, this angular sector is less than 120°.

In a more particular embodiment illustrated in the Figures, this angular sector is less than 90°.

Calendar mechanism 100 includes elastic return means arranged to instantaneously return month cam 1 in a backward movement, in cooperation with month feeler 4, to the position of the first month of the year upon completion of the last day of the preceding year.

Month cam 1 includes an edge 18 which is arranged to cooperate, on the last day of the year, with an off-centre stop member 78 comprised in calendar mechanism 100, to cause a backward movement of month cam 1 under the action of the elastic return means.

The invention also concerns a timepiece 300 including a movement 200 arranged to drive such a calendar mechanism 100 according to the invention.

This movement 200 may equally be a mechanical movement or an electronic movement, in which case the mechanical part of the timepiece may, in a particular non-limiting embodiment, be limited simply to the time display and associated functions, such as the chronograph, time zone or other functions, and to calendar mechanism 100 of the invention, which may be enhanced in a skeleton or similar embodiment.

The actuation of calendar mechanism 100 is therefore controlled by a timepiece movement 200, which controls the rotation of drive means 2, which notably includes an arbor 20.

In the particular and non-limiting embodiment illustrated in the Figures, calendar mechanism 100 includes a cylindrical assembly 50, comprising a month drum 40 for the month display, and a leap year drum 30 for the ordinary leap year display over a four-year cycle, coaxial along an axis C, and each mounted for free rotation about said axis C.

More generally, calendar mechanism 100 includes, for implementation of the invention, at least one wheel set completing one revolution in six or twelve months, and another wheel set completing one revolution in four years.

Arbor 20 has drive surfaces 21 comprising flat portions, flutes or similar, for guiding sliding gears that can move longitudinally in direction A of arbor 20. In the non-limiting example of the Figures, arbor 20 bears in succession a first sliding wolf-tooth gear 23 and a second sliding wolf-tooth gear 24. This second sliding wolf-tooth gear 24 is arranged to cooperate with a first combined sliding wheel set that rotates freely, comprising a wolf-tooth 25 complementary to the second sliding wolf-tooth gear 24, and a first pinion 26. A second freely rotating combined sliding wheel set comprises a second pinion 28 and another wolf-tooth 27.

The first sliding wheel set and second sliding wheel set are mounted for free rotation on arbor 20, only first sliding wolf-tooth gear 23 and second sliding wolf-tooth gear 24 are driven by drive surfaces 21 of arbor 20. Levers (not shown) may or may not engage the first sliding wheel set and second sliding wheel set with wheels, respectively 45 and 36 comprised in cylindrical assembly 50. The first sliding wolf-tooth gear 23 and second sliding wolf-tooth gear 24 are arranged, in a contact position, to drive in rotation the first sliding wheel set comprising first pinion 26. They are each arranged with a groove for controlling their longitudinal movement, in a similar manner to a time-setting mechanism with levers.

Month drum 40 includes a first end flange 43, integral in rotation with a wheel 45 driven by first pinion 26 when the latter is in the appropriate position. Drive wheel 45 completes one revolution in 6 months.

Month drum 40 also includes a second end flange 49 integral in rotation with first end flange 43. In the non-limiting variant illustrated, the second end flange 49 and first end flange 43 bear a set of substantially flat, pivoting blades 48, pivoted by pins 48 in the flanges. One of two consecutive blades 47 bears the upper half and the other bears the lower half of the name of a month of the year, to display the name of the month in an aperture. Twelve blades 47 can thus display six of the twelve calendar months; the other six months can be read on the other sides of the blades, which are pivoted, half-way through the year, or at the change in month, by the action of a cam which acts either directly on the blades, for example inside month drum 40, or when each blade passes over a rocker guide on the main plate or a bridge, or outside month drum 40 by the action of a cam pivoting a lever integral with a pin 44, 48, integral with the blade 47 concerned.

The second end flange 49 bears a twelve-star 41 with wolf teeth which, in the illustrated variant, comprises six equal fields forming notches each including a month change ramp 42. Each month change ramp causes star 41 to advance by one step, over one sixth of a revolution.

Complementary drive means 3 include, cooperating with this twelve-star 41, a first lever 61 comprising a finger 63 arranged to actuate an intermediate twelve-star 64 which, via a pinion 65, controls the driving of a large wheel 75.

A first lever 61 is mounted to pivot on a main plate or similar, and carries a feeler finger 62 which cooperates with star 41 and follows the notches comprised therein. When feeler finger 62 climbs a ramp 42, at each month end, this ramp tips and pivots first lever 61, which in turn drives, at the opposite end thereof, a pivoting hinged finger 63 returned by a spring (not shown in the Figures). This finger 63 then pushes through one step an intermediate twelve-star 64, which is held by a jumper (not shown) and completes one revolution per year.

Intermediate twelve-star 64 is coaxial and integral with a pinion 65, which drives a large wheel 75 integral with a ring 71 which includes four year notches 72. This large wheel 75 forms a year wheel set, which completes one revolution in four years.

Month cam 1 is a retrograde twelve-month cam here, integral with a hub 11, which pivots in large wheel 75. Month cam 1 is intended to be returned by a spiral spring or similar element (not shown), towards an angular position in which month feeler arm 4 cooperates with an elementary surface of periphery 10 that corresponds to January. Month cam 1 also cooperates, directly or as illustrated by means of hub 11, with a spring 13, which includes a lug 12 which causes it cooperate each year with one of the four notches 72 of ring 71 and which changes notch every year.

In short, calendar mechanism 100 includes a large wheel 75 forming a year wheel set, and which completes one revolution in four years, and which is integral with a ring 71 that comprises four equidistant year notches 72, and during one calendar year, a notch 72 holds a lug 12, comprised in a spring 13, integral in rotation with month cam 1.

During any given year, month cam 1 is driven by large wheel 75 each time that beak 63 of the feeler arm drives intermediate-twelve-star 64.

Indeed, at the end of the year, on the last day of December, an edge 18 of month cam 1, which turns counter clockwise, abuts against an off-centre stop member 78, which releases month cam 1 and uncouples spring 13 causing lug 12 to leave notch 72. Under the action of its return spring, month cam 1 returns clockwise and lodges in the next notch 72 and thus starts another year.

In short, calendar mechanism 100 comprises an off-centre stop member 78 arranged to act as a stop, on the last day of December, for an edge 18 of month cam 1 to uncouple spring 13 causing lug 12 to leave notch 72 in which it was lodged during the past year, in order, under the action of its return means (not shown in the Figures), to allow month cam 1 to move backwards and lodge lug 12 in the next notch 72 for the duration of the new year.

The calendar mechanism 100 is illustrated here with a leap year drum 30, comprising a display drum 32, arranged for the display of the ordinary years or the leap year (symbolised by a letter B) over a four-year cycle. This display drum 32 is integral, on a first side, with a toothed wheel 36 and a cam 37 to actuate uncoupling levers for sliding pinions and levers so as to drive other twelve-month and four-year cams that are not illustrated here, and on a second side, with a four-year cam 33.

In a particular variant embodiment of the invention, the leap year drum 30 therefore includes a four-year cam 33, which completes one revolution in four years, and which includes a first track 34 on a first level for the leap year over one quarter of a revolution, and a second track 35 on a second level over three-quarters of a revolution for the three ordinary years. A second lever 91 includes a first end 92 which feels the profile of the four-year cam 33, and a second end provided with a toothed sector 93.

This toothed sector 93 pivots an leap year arm 95, forming a leap year cam, having a distal end covering one portion of a notch of periphery 10 of month cam 1. Advantageously, the February notch of this periphery 10 is created for a twenty-eight day month. The combination of leap year arm 95 with month cam 1 creates the fiction of a twenty-nine day month for a double-width feeler arm 4, arranged to bear both on periphery 10 and on the edge 96 of leap year arm 95, when first end 92 of second lever 91 follows the first leap-year track 34.

In short, calendar mechanism 100 includes a four-year cam 33, which completes one revolution in four years, and which includes a first track 34 on a first level for the leap year over one quarter of a revolution, and a second track 35 on a second level over three-quarters of a revolution for the three ordinary years. Calendar mechanism 100 also includes a second lever 91 which includes a first end 92 that feels the profile of four-year cam 33, and a second end provided with a toothed sector 93 that drives the pivoting of a toothing 94 of an leap year arm 95 forming a leap year cam. A distal end of leap year arm 95 covers one portion of periphery 10 of month cam 1, where the profile for February is made for a twenty-eight day month. The combination of leap year arm 95 with month cam 1 creates the fiction of a twenty-nine day month for a double-width feeler arm 4, arranged to bear both on periphery 10 and on an edge 96 of the distal end of leap year arm 95, when first end 92 of second lever 91 follows the first leap-year track 34.

The invention also permits display of the year. Calendar mechanism 100 thus includes a display means 5 for displaying the current year, and the backward return movement of month cam 1 increments display means 5 by one unit, to display the following year. This increment can notably be implemented, at the change from the thirty-first of December to the first of January of a new year, for example by a cam driving a lever joining the first sliding wolf-tooth gear 23 to the second sliding wheel set comprising wolf tooth 27.

The invention provides a significant space saving. The mode of driving the month cam is very special and does not waste any energy.

The number of operations made by the user to perform an update is reduced, owing to the use of month cam 1 which covers twelve months, to a maximum number of thirteen operations instead of forty-seven for a conventional calendar mechanism.

What is claimed is:

1. A timepiece calendar mechanism, comprising drive means arranged to drive, at each change in month, complementary drive means arranged to drive a month cam pivoting about a pivot axis, said month cam comprising a periphery which cooperates with a month feeler arm comprised in said calendar mechanism, wherein said month feeler arm always occupies the same angular position with respect to said pivot axis, and wherein said month cam covers an angular sector of less than 360° with respect to said pivot axis, and wherein said calendar mechanism includes elastic return means arranged to instantaneously return said month cam in a backward movement, in cooperation with said month feeler arm, to the position of the first month of the year upon completion of the last day of the preceding year, and said month cam comprising an edge arranged to cooperate, on the last day of the year, with an off-centre stop member comprised in said calendar mechanism, to cause a backward movement of said month cam under the action of said elastic return means.

2. The calendar mechanism according to claim 1, wherein said calendar mechanism includes a large wheel forming a year wheel set, and which completes one revolution in four years, and which is integral with a ring that comprises four equidistant year notches, and wherein during one calendar year, a said notch holds a lug, comprised in a spring, integral in rotation with said month cam.

3. The calendar mechanism according to claim 2, wherein said off-centre stop member is arranged to act as a stop, on the last day of December, for said edge of said month cam to uncouple said spring allowing said lug to leave the notch in which it was lodged during the preceding year, in order, under the action of said elastic return means thereof, to allow said month cam to move backwards and lodge said lug in the next said notch for the duration of the new year.

4. The calendar mechanism according to claim 2, wherein said calendar mechanism includes a twelve-star which comprises equal fields forming notches each including a ramp, each change in month causing said twelve-star to advance one step, to cause the pivoting of a first lever which comprises a pivoting hinged finger arranged to push through one step an intermediate twelve-star held by a jumper, and which completes one revolution per year, said intermediate twelve-star being coaxial and integral with a pinion which drives said large wheel.

5. The calendar mechanism according to claim 1, wherein said calendar mechanism includes a four-year cam which completes one revolution in four years, and which includes a first track on a first level for the leap year over one quarter of revolution, and a second track on a second level over three-quarters of a revolution for the three ordinary years, and comprises a second lever which includes a first end that feels the profile of said four-year cam, and a second end provided with a toothed sector that drives the pivoting of a toothing of an leap year arm, forming a leap-year cam, whose distal end covers one portion of the periphery of said month cam whose profile for February is made for a twenty-eight day month, the combination of said leap year arm with said month cam creating the fiction of a twenty-nine day month for a double-width feeler arm, arranged to bear both on said periphery and on an edge of said distal end of said leap year arm, when said first end of said second lever follows said first leap-year cam.

6. The calendar mechanism according to claim 1, wherein said calendar mechanism includes a display means for displaying the current year, and wherein the backward return movement of said month cam increments display means by one unit, for the display of the following year.

7. The calendar mechanism according to claim 1, wherein said angular sector of said month cam is less than 120°.

8. A watch comprising a movement arranged to drive a calendar mechanism according to claim 1.

* * * * *